US008023854B2

(12) United States Patent
Sato et al.

(10) Patent No.: US 8,023,854 B2
(45) Date of Patent: Sep. 20, 2011

(54) IMAGE FORMING APPARATUS HAVING POWER SUPPLYING PATH

(75) Inventors: Hiroyuki Sato, Saitama (JP); Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 24 days.

(21) Appl. No.: 12/606,230

(22) Filed: Oct. 27, 2009

(65) Prior Publication Data

US 2010/0239304 A1 Sep. 23, 2010

(30) Foreign Application Priority Data

Mar. 18, 2009 (JP) ..... 2009-066881

(51) Int. Cl.
*G03G 15/00* (2006.01)

(52) U.S. Cl. ..... 399/90; 399/88

(58) Field of Classification Search ..... 399/88–90
See application file for complete search history.

(56) References Cited

U.S. PATENT DOCUMENTS

| | | | | |
|---|---|---|---|---|
| 7,286,783 | B2 * | 10/2007 | Portig et al. | 399/90 |
| 7,379,694 | B2 * | 5/2008 | Takiguchi et al. | 399/313 |
| 2004/0028424 | A1 | 2/2004 | Yokoi | |
| 2006/0159483 | A1 | 7/2006 | Yokoi | |

FOREIGN PATENT DOCUMENTS

| | | | |
|---|---|---|---|
| JP | 4-55059 | U | 5/1992 |
| JP | 5-19552 | A | 1/1993 |
| JP | 6-19229 | A | 1/1994 |
| JP | 7-160171 | A | 6/1995 |
| JP | 08-129330 | A | 5/1996 |
| JP | 8-160840 | A | 6/1996 |
| JP | 10-254328 | A | 9/1998 |
| JP | 2000-47505 | A | 2/2000 |
| JP | 2001-134164 | A | 5/2001 |
| JP | 2004-77565 | A | 3/2004 |

OTHER PUBLICATIONS

Notification of Reasons for Refusal dated Jan. 28, 2011, in counterpart Japanese Application No. 2009-066881.

* cited by examiner

*Primary Examiner* — Hoang Ngo
(74) *Attorney, Agent, or Firm* — Sughrue Mion, PLLC

(57) ABSTRACT

An image forming apparatus comprises: a housing that is fixedly placed in the image forming apparatus and integrally accommodates an imaging portion that includes at least an image holding member; a transferring unit that is disposed against the image holding member so that the transferring unit is capable of pressing and separating the image holding member; and a high-voltage power supplying unit that supplies a high voltage, wherein a power supplying path that is formed on an outer surface of the housing so that the high voltage is supplied from the high-voltage power supplying unit to the imaging portion and the transferring unit via the power supplying path.

5 Claims, 14 Drawing Sheets

IMAGE FORMING APPARATUS HAVING POWER SUPPLYING PATH

CROSS-REFERENCE TO RELATED APPLICATION

This application is based on and claims priority under 35 USC 119 from Japanese Patent Application No. 2009-066881 filed on Mar. 18, 2009.

BACKGROUND

1. Technical Field

The present invention relates to an image forming apparatus.

2. Related Art

Among image forming apparatuses such as copiers and printers using electrophotography or the like, an image forming apparatus of a so-called process cartridge type is known in which replacement parts such as a photoreceptor drum, a charging device and a developing device are integrated into a unit so that the user can detachably attach the unit to the image forming apparatus body

SUMMARY

According to an aspect of the invention, an image forming apparatus comprises: a housing that is fixedly placed in the image forming apparatus and integrally accommodates an imaging portion that includes at least an image holding member; a transferring unit that is disposed against the image holding member so that the transferring unit is capable of pressing and separating the image holding member; and a high-voltage power supplying unit that supplies a high voltage, wherein a power supplying path that is formed on an outer surface of the housing so that the high voltage is supplied from the high-voltage power supplying unit to the imaging portion and the transferring unit via the power supplying path.

BRIEF DESCRIPTION OF THE DRAWINGS

Exemplary embodiments of the invention will be described in detail based on the following figures, wherein.

DETAILED DESCRIPTION

Figure 1:
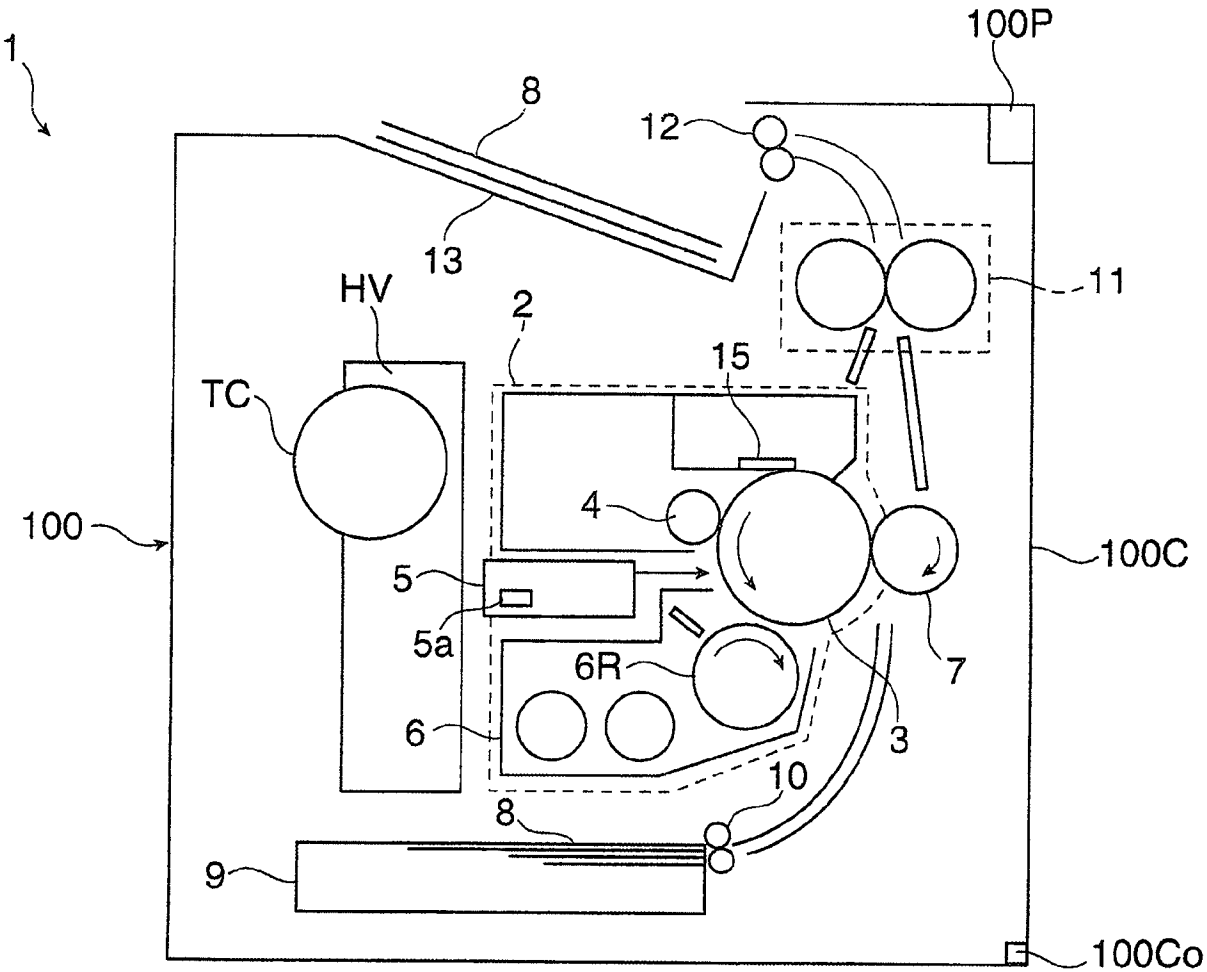
FIG. 1 is a schematic diagram for explaining the schematic structure of an image forming apparatus according to an exemplary embodiment of the present invention.
Figure 2:
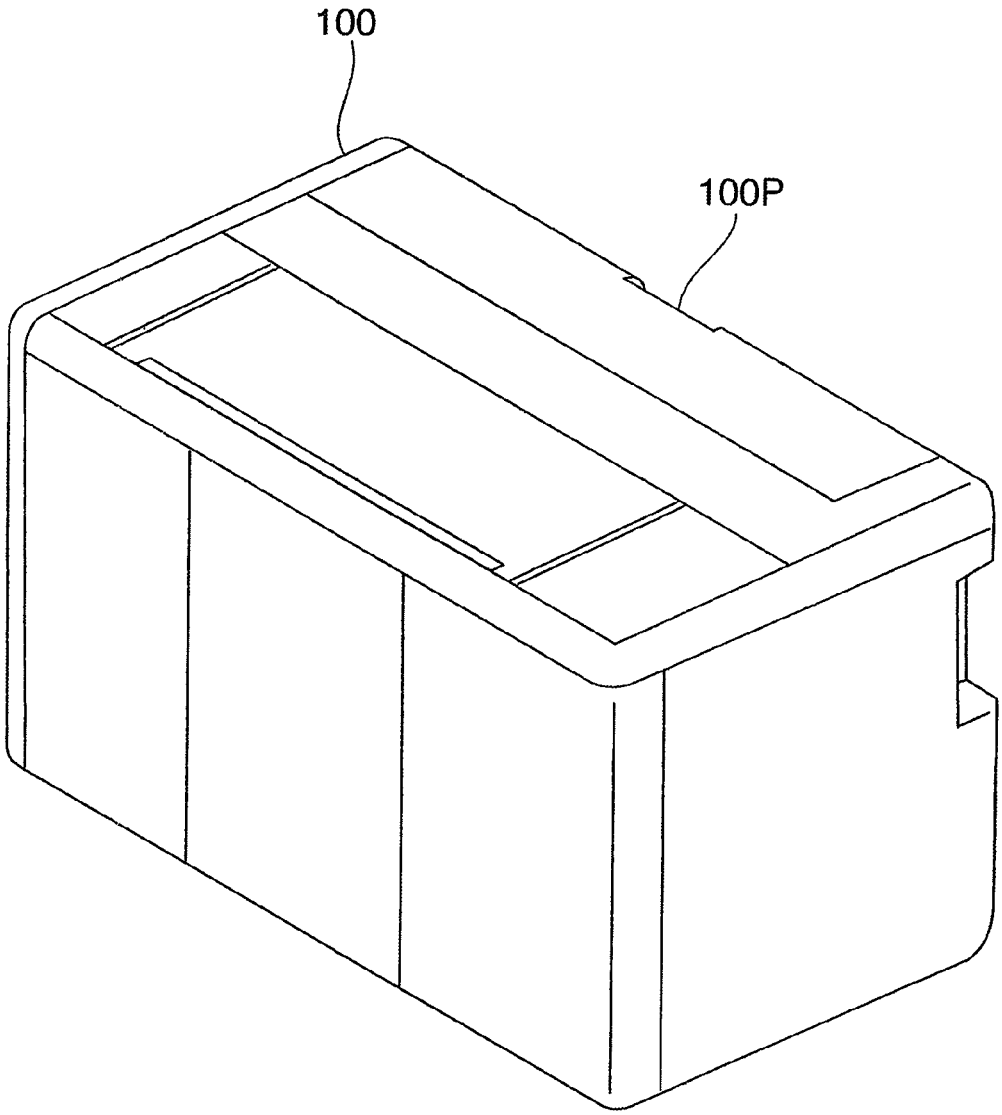
FIG. 2 is a perspective view, viewed from the front side, showing the appearance of the image forming apparatus according to the exemplary embodiment of the present invention.
Figure 3:
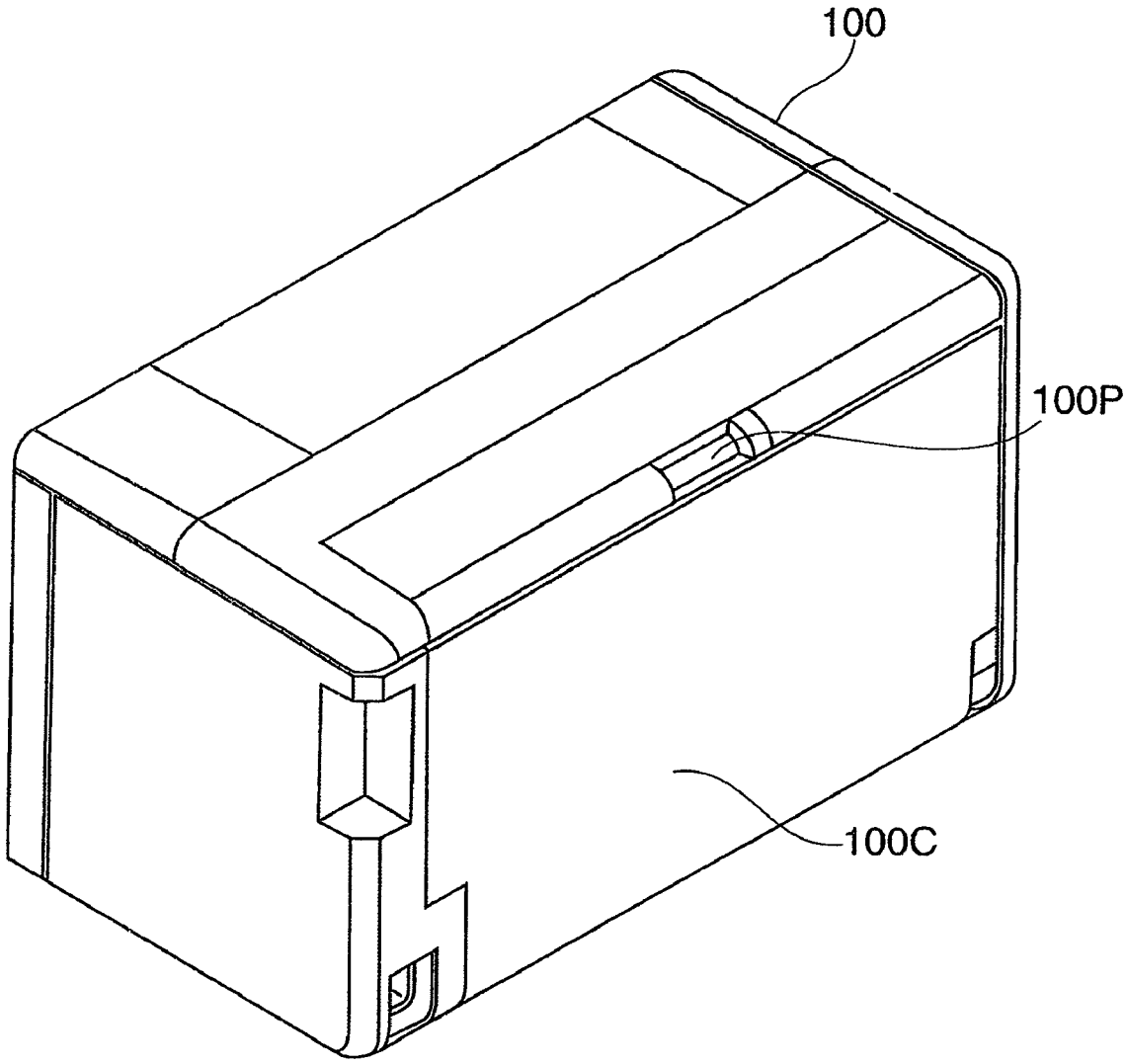
FIG. 3 is a perspective view, viewed from the back side, showing the appearance of the image forming apparatus according to the exemplary embodiment of the present invention.

Hereinafter, an exemplary embodiment of the present invention will be described with reference to FIGS. 1 to 6. FIG. 1 is a schematic diagram showing the schematic structure of a printer as an example of the image forming apparatus according to the present invention. FIGS. 2 to 5 are perspective views showing the external structure of the printer according to the present exemplary embodiment. FIG. 6 is a schematic enlarged view for explaining the structure of a jam processing cover to which a transferring roll is attached.

As shown in FIGS. 1 to 5, the printer 1 as the image forming apparatus according to the present exemplary embodiment is provided with a hollow substantially rectangular parallelepiped apparatus body 100, and a process unit 2 as the imaging portion, a transferring roll 7 as the transferring unit, a high-voltage unit HV as the high-voltage power supplying unit, a paper feeding tray 9, a fixing device 11 and the like are disposed in the apparatus body 100.

On the back side of the apparatus body 100, a jam processing cover 100C formed so as to be rotatable about the a rotation support $\mathbf{100}C_0$ is provided for so-called jam processing performed when a paper jam or the like occurs. Specifically, in an upper part of the jam processing cover 100C, an operation button 100P is provided in a substantially central part in the direction of the length, and the jam processing cover 100C can be opened and closed by pressing (pushing up) the operation button 100P.

In the present exemplary embodiment, the jam processing cover 100C is interlocked with a non-illustrated power switch so that no apparatus power is supplied (the apparatus is turned oft) when the cover 100C is opened.

Figure 5:
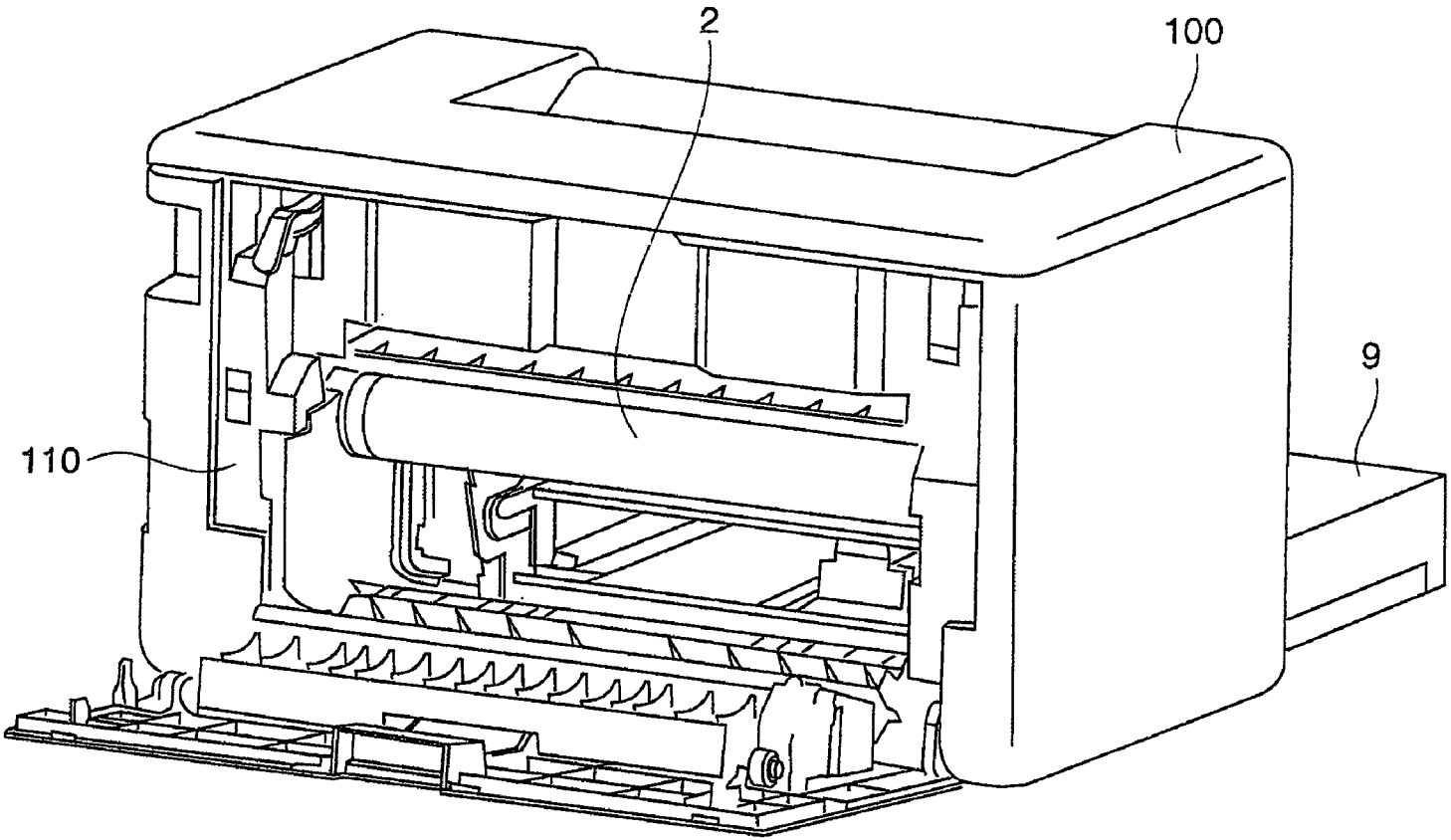
FIG. 5 is a perspective view showing the condition of attachment of a process unit in the image forming apparatus according to the exemplary embodiment of the present invention.
Figure 6:
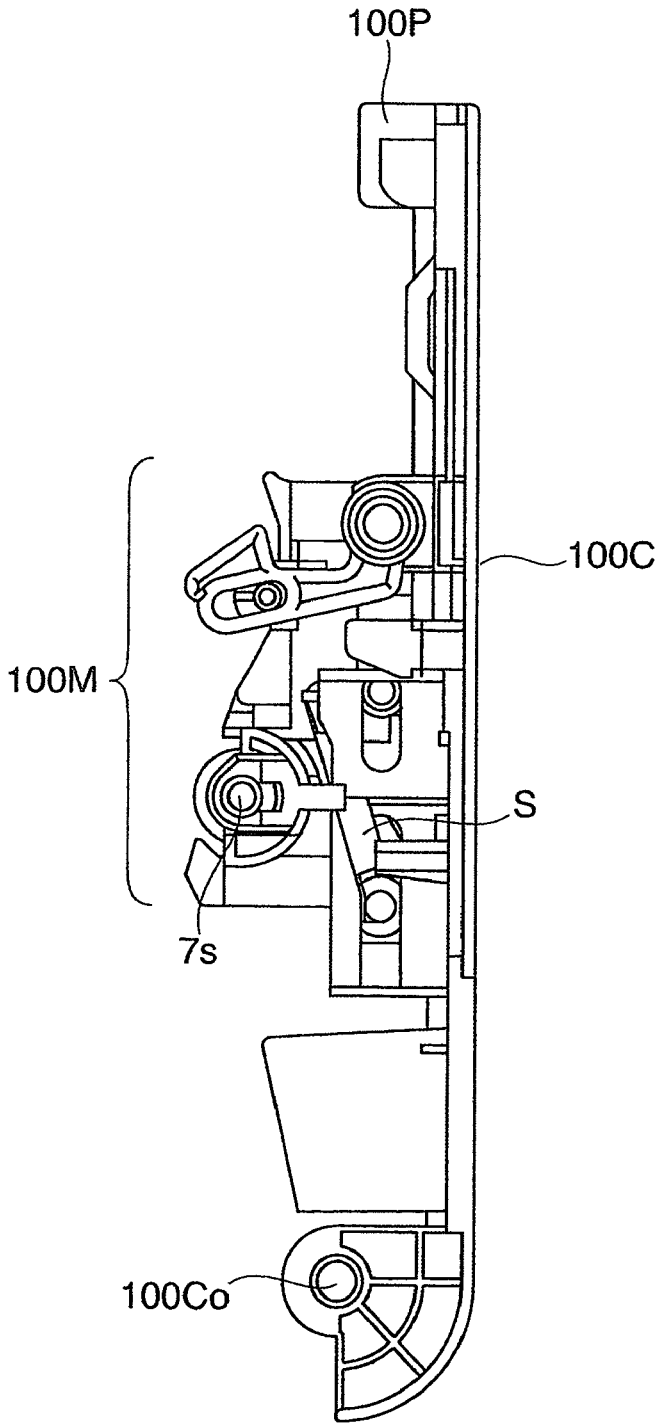
FIG. 6 is a schematic enlarged view for explaining the structure of the jam processing cover to which a transferring roll is attached.

Further, in the printer 1 according to the present exemplary embodiment, as most clearly shown in FIG. 5, a frame-shaped (gate-shaped) inner frame 110 that covers both ends in the axial direction of the process unit 2 is fixedly provided on the back side of the inside of the apparatus body 100 (inside the jam processing cover 100C), and in order that the user who is the operator cannot make an approach such as attaching or detaching the process unit 2, the process unit 2 is fixed inside the inner frame 110. That is, in the printer 1 according to the present exemplary embodiment, for example, it is intended that the replacement of the process unit 2, the maintenance of the component devices in the process unit 2 and the like are performed through a maintenance work by an expert service person; therefore, an expert service person visits the user for replacement, maintenance or the like, or the user sends the printer 1 for replacement, maintenance or the like.

As shown in FIG. 1, a photoreceptor drum 3 included in the process unit 2 according to the present exemplary embodiment is formed by coating the peripheral surface of a grounded metal cylinder with a photoconductive material such as an OPC, and is rotated at a predetermined speed in the direction of the arrow (in this example, in the counterclockwise direction) by non-illustrated driving unit. The surface of the photoreceptor drum 3 is uniformly charged to a predetermined potential by a charging roll 4, and then, image exposure is performed thereon in accordance with the image data by an exposing device 5 to thereby form an electrostatic latent image corresponding to the image data. To the exposing device 5, for example, an image signal from a connected apparatus such as a personal computer is inputted. As the exposing device 5, one constituted by an LED array, a semiconductor laser scanning device or the like may be used. In the present exemplary embodiment, the high-voltage unit HV supplying a predetermined high voltage to the component devices in the process unit 2 is disposed on the front side of the apparatus so as to be opposed to the process unit 2. Reference designation TC represents a toner cartridge as the toner accommodating container that supplies toner to a developing device 6. The developing device 6 is mounted in the printer 1 so as to be detachable and attachable.

The electrostatic latent image formed on the photoreceptor drum 3 is developed into a toner image by the developing device 6 as the developing unit, and the toner image is transferred onto a recording sheet 8 as a recording medium by the transferring roll 7 as the transferring unit. As the recording sheet 8, one of a predetermined size and a predetermined material is supplied from the paper feeding tray 9 by a pair of paper feeding rolls 10 in a condition of being separated sheet by sheet, and is conveyed to the transfer position of the photoreceptor drum 3 through a non-illustrated resist roll at a predetermined timing.

Figure 4:
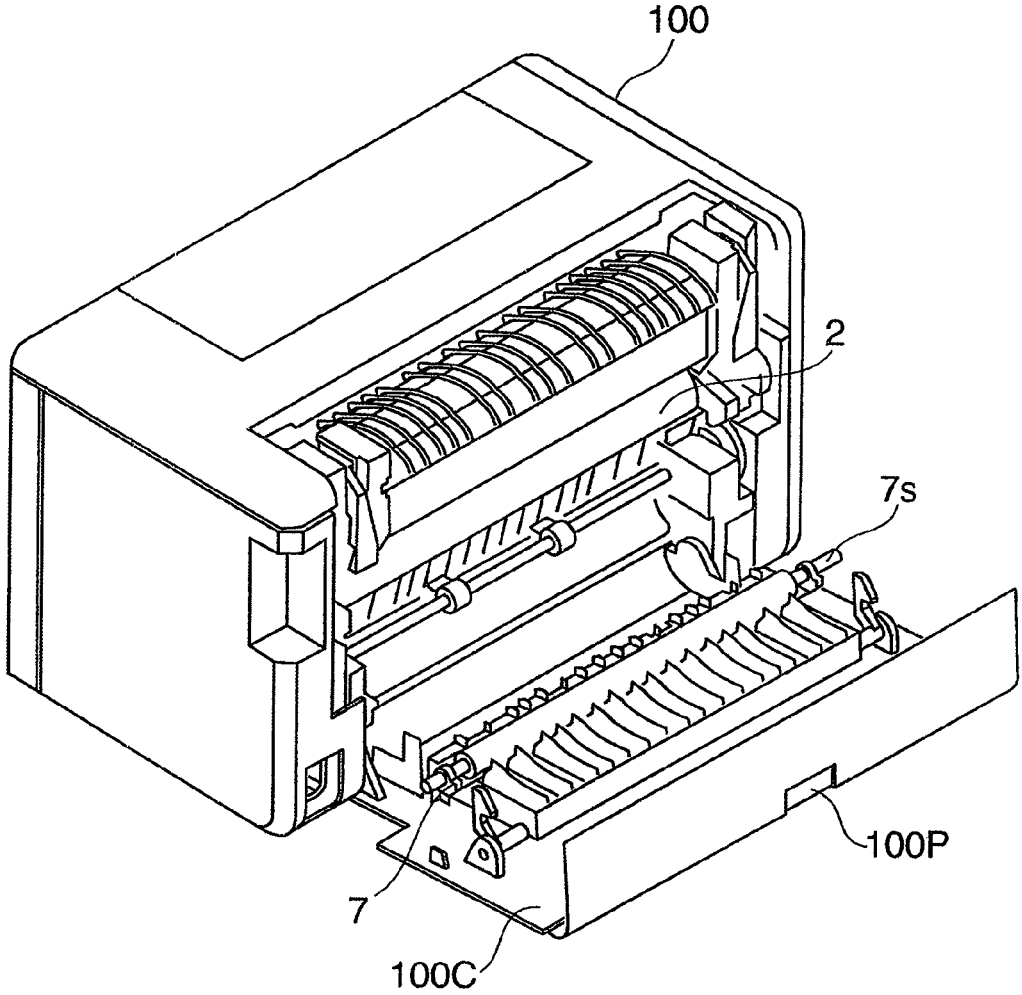
FIG. 4 is a perspective view showing a condition where a jam processing cover is opened in the image forming apparatus according to the exemplary embodiment of the present invention.

In the present exemplary embodiment, as most clearly shown in FIG. 4, the transferring roll 7 has a conductive (metal) rotation shaft 7*s* having its surface coated with an elastic material such as rubber, rotates so as to follow the rotation of the photoreceptor drum 3, and is integrally attached to the above-described jam processing cover 100C. The transferring roll 7 can be pressed against the photoreceptor drum 3 and separated therefrom in response to the opening and closing of the jam processing cover 100C.

Specifically, as shown in the enlarged view of FIG. 6, the transferring roll 7 according to the present exemplary embodiment is attached to a movable portion 100M that is interlocked with the operation button 100P of the jam processing cover 100C to move relatively to the opposed surface of the cover 100C in the direction of operation of the operation button 100P (in this example, in the downward direction of the figure), and in a lower part of the movable portion 100M, a compression spring S that pushes the movable portion 100M in the opposite direction (in this example, in the upward direction of the figure) is attached. Consequently, as described later in detail, when the jam processing cover 100C is opened, by the operator pressing (pushing down) the operation button 100P, the transferring roll 7 moves downward from a predetermined contact position where it is in contact with the photoreceptor drum 3 so as to be opposed thereto, so that the transferring roll 7 is separated from the photoreceptor drum 3. When the jam processing cover 100C is closed, the transferring roll 7 pushed by the compression spring S moves upward to return to the predetermined contact position.

The recording sheet 8 having the toner image transferred thereonto is separated from the surface of the photoreceptor drum 3, and then, conveyed to the fixing device 11. Then, the unfixed toner image is fixed onto the recording sheet 8 by heat and pressure by the fixing device 11, and the recording sheet 8 is ejected onto an output tray 13 provided at the upper end of the printer body 1 by paper ejecting rolls 12 with the image formed surface facing downward.

The untransferred remaining toner not transferred onto the recording sheet 8 but remaining on the surface of the photoreceptor drum 3 is removed by the cleaning blade of a cleaning device 15.

Figure 7:
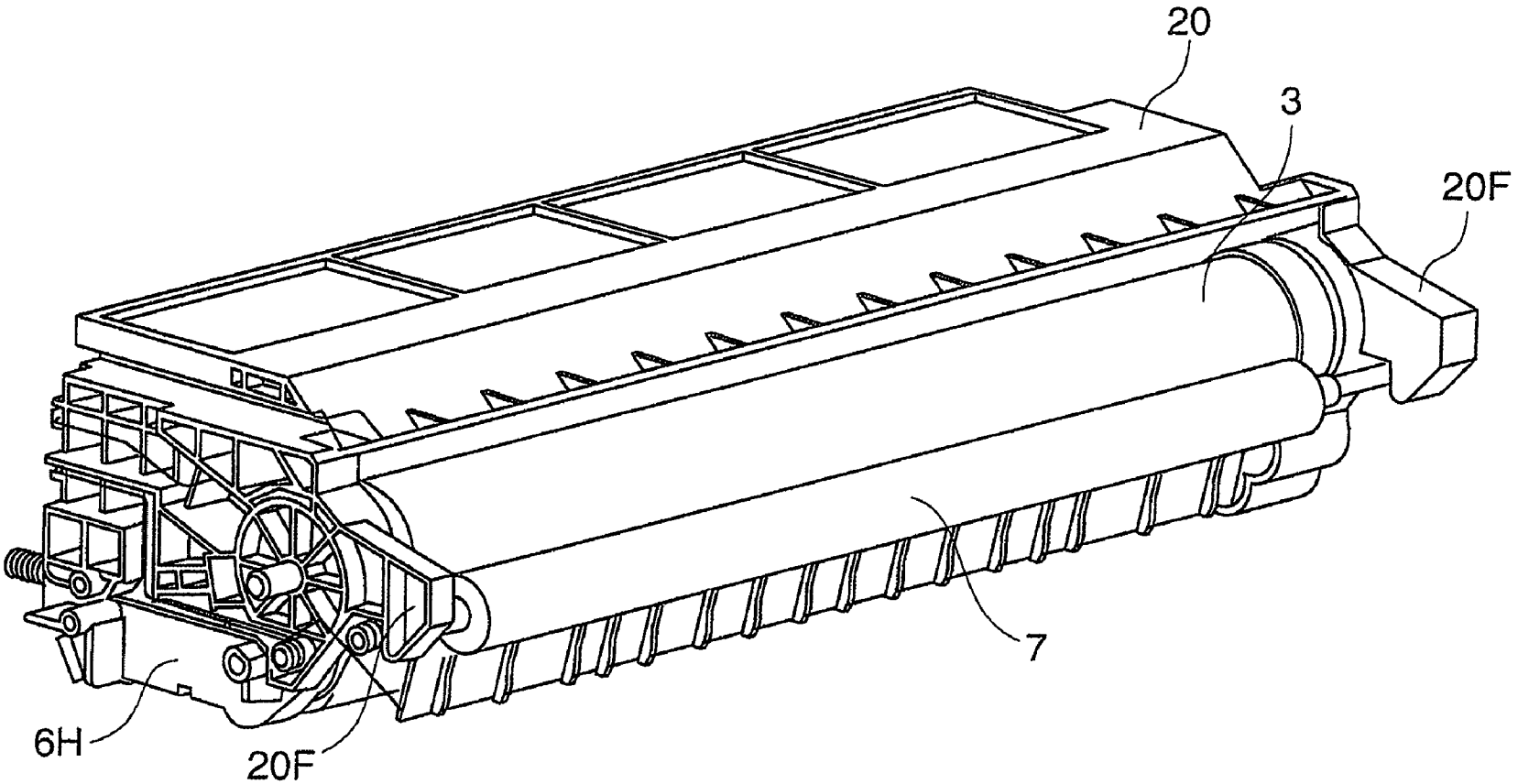
FIG. 7 is a perspective view showing the structure of the process unit according to the exemplary embodiment of the present invention.
Figure 8:
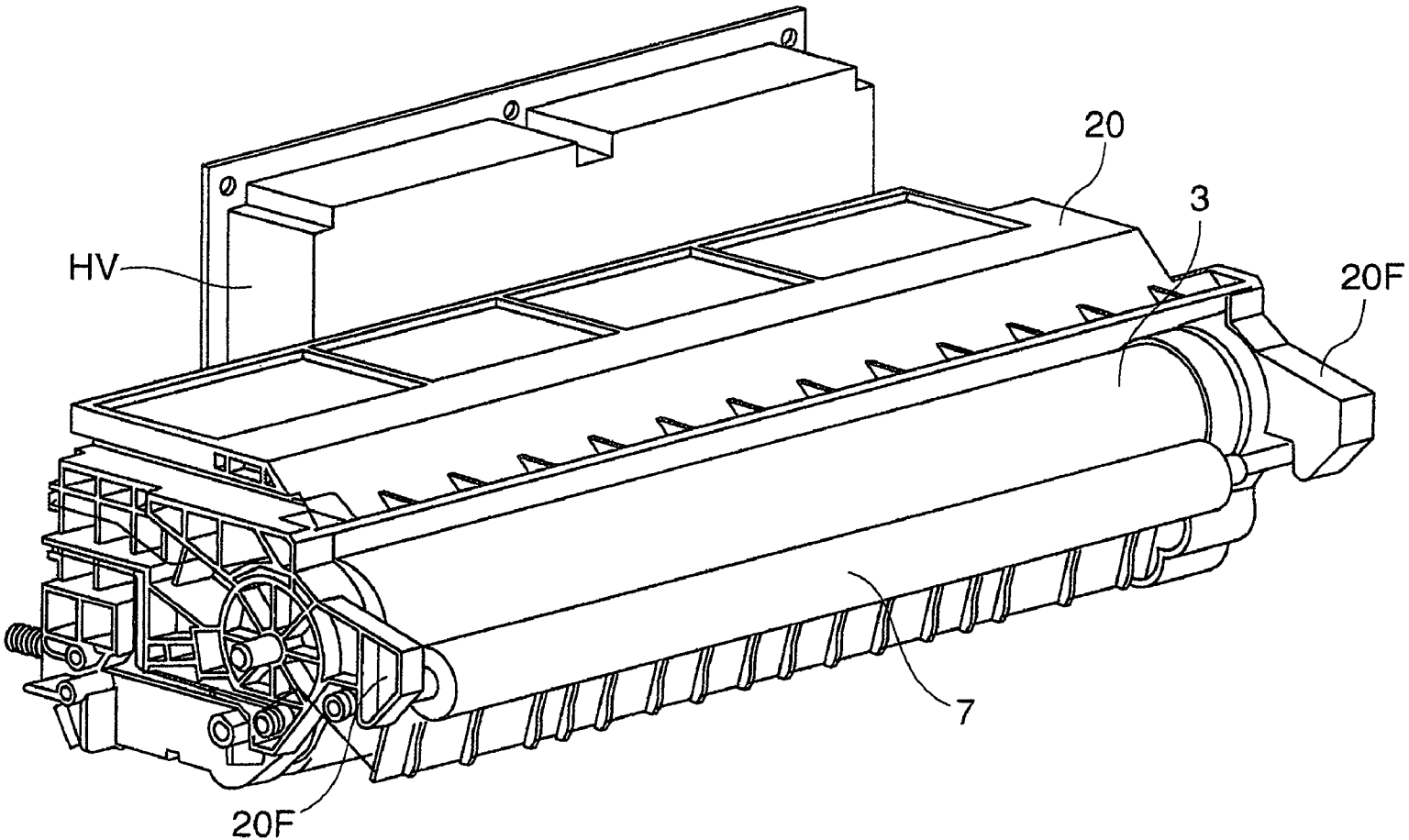
FIG. 8 is a perspective view showing the disposition of the process unit and a high-voltage unit according to the exemplary embodiment of the present invention.
Figure 9:
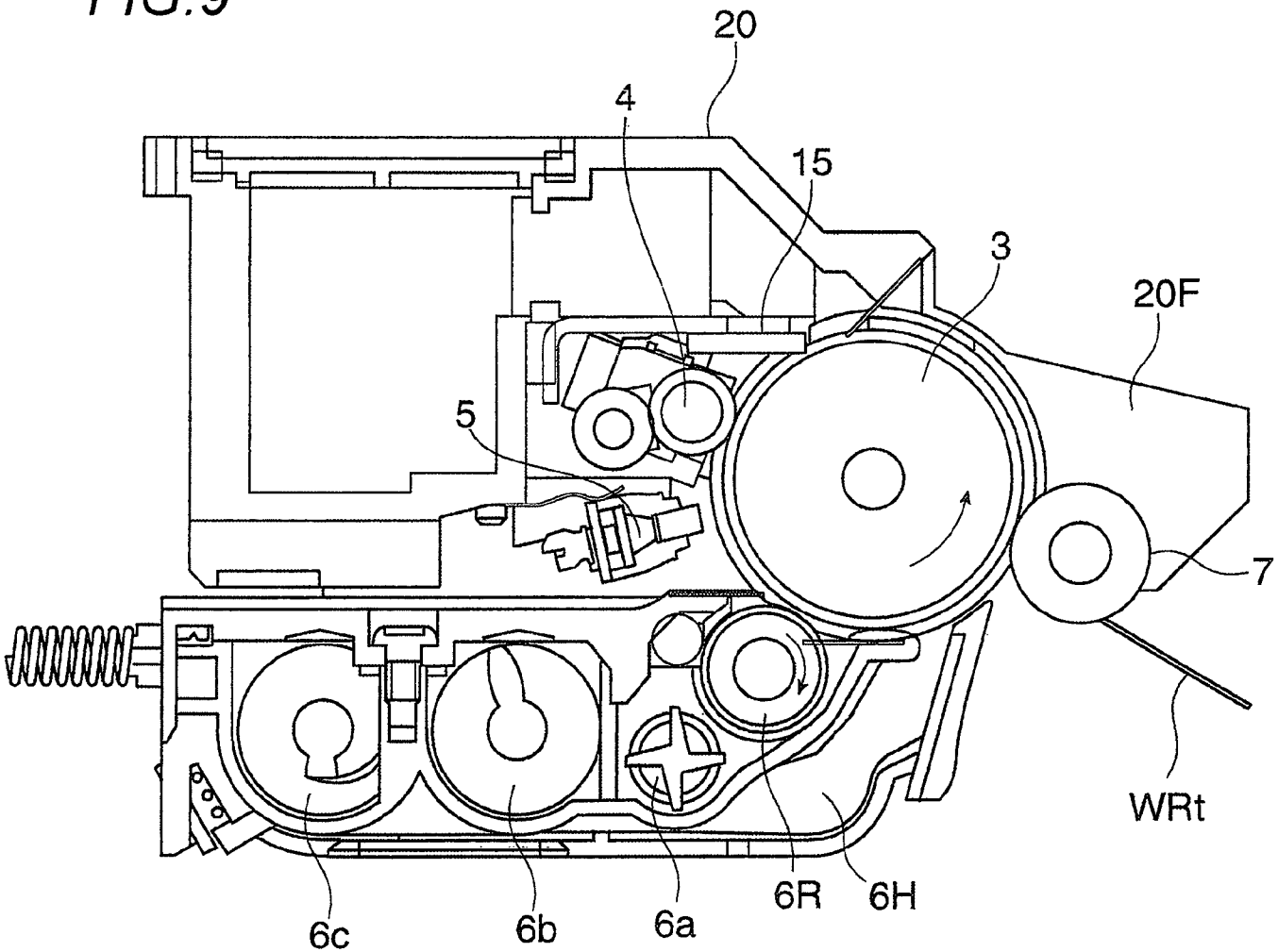
FIG. 9 is a schematic cross-sectional view showing the structure of the process unit according to the exemplary embodiment of the present invention.
Figure 10:
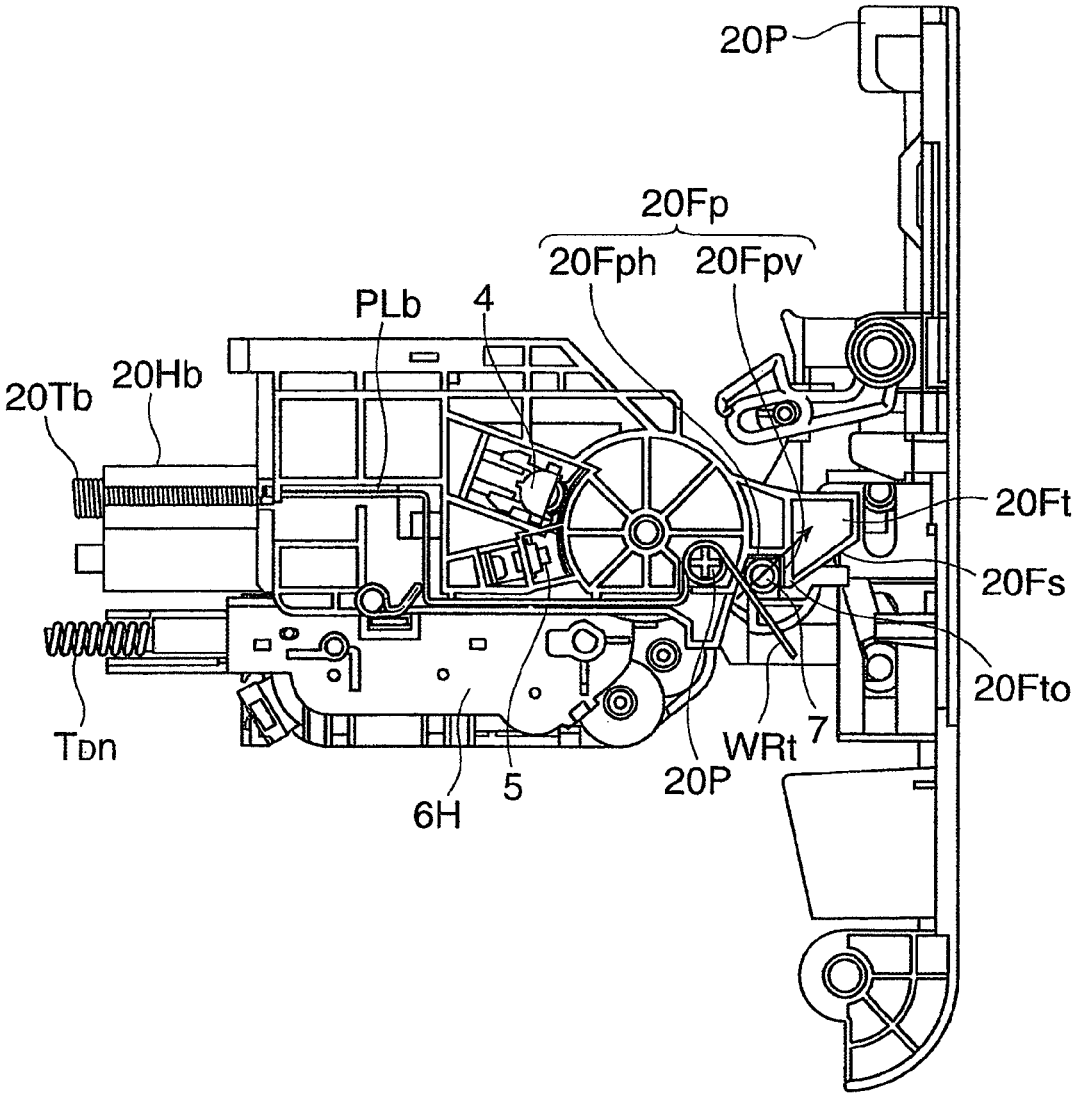
FIG. 10 is a schematic cross-sectional view showing the structure of a transferring roll holding portion according to the exemplary embodiment of the present invention.

Next, the structure of the process unit 2 as the imaging portion according to the present exemplary embodiment will be described with reference to FIGS. 7 to 10. FIGS. 7 and 8 are perspective views for explaining the structure of the process unit 2 according to the present exemplary embodiment. FIG. 9 is a schematic cross-sectional view. FIG. 10 is a schematic cross-sectional view showing the structure of transferring roll holding portions 20F of the jam processing cover 100C.

As shown in FIGS. 7 to 9, the process unit 2 according to the present exemplary embodiment has an elongated hollow substantially rectangular parallelepiped unit case 20 having an opening. In the opening of the unit case 20, the photoreceptor drum 3 as the image holding member is disposed so as to be rotatable, and at both ends in the axial direction on the front side of the unit case 20 (on the side of the opening; in this example, on the back side of the apparatus body 100), the transferring roll holding portions 20F having a downward hook shape (downward L shape) so as to cover the rotation shaft 7*s* of the transferring roll 7 from above and holding the transferring roll 7 attached to the jam processing cover 100C, in a predetermined position are formed integrally with the unit case 20 so as to protrude along the side surfaces of the unit case 20.

Specifically, the transferring roll holding portions 20F each have, as schematically shown in FIG. 10, a substantially trapezoidal end portion 20Ft and a substantially rectangular positioning portion 20Fp provided at the rear (on the photoreceptor drum 3 side) of the end portion 20Ft and accommodating the rotation shaft 7*s* of the transferring roll 7. On the trapezoidal end portion 20Ft, a slanting surface 20Fs slanting downward from the side of the cover 100C toward the photoreceptor drum 3 is formed. The slanting surface 20Fs is formed and disposed so that it comes into contact with the transferring roll 7 attached integrally with the jam processing cover 100C (so that the movement path of the transferring roll 7 and the slanting surface 20Fs intersect each other) when the jam processing cover 100C is rotated in the closing direction from the opened condition. Consequently, with the closing of the jam processing cover 100C (in this example, rotation in the counter clockwise direction of the figure), the transferring roll 7 comes into contact with the downward slanting surface 20Fs of the transferring roll holding portions 20F, moves downward along the inclination of the slanting surface 20Fs against the pushing force of the compression spring S, and is led into the positioning portion 20Fp of the transferring roll holding portions 20F by the elastic force of the compression spring S at the point of time when it climbs over a lower end 20$Ft_0$ of the slanting surface 20Fs.

The positioning portion 20Fp of the transferring roll holding portions 20F according to the present exemplary embodiment is constituted by a horizontal surface 20Fph and a vertical surface 20Fpv, and by disposing the transferring roll 7 so that the peripheral surface at both ends in the axial direction of the rotation shaft 7*s* of the transferring roll 7 is in contact with the horizontal surface 20Fph and the vertical surface 20FpV, the holding position (hereinafter, also referred to as contact position) of the transferring roll 7 is set so that a predetermined pressing force to the photoreceptor drum 3 is obtained. That is, in the printer 1 according to the present exemplary embodiment, by using tracking rolls for bringing the transferring roll 7 into contact with the photoreceptor drum 3 at both ends of the transferring roll 7 without providing on the side of the jam processing cover 100C a pushing member for applying a pressing force for pressing the tracking roll against the photoreceptor drum 3, the predetermined pressing force to the photoreceptor drum 3 is obtained only by the above-described positioning of the transferring roll 7, and this enables a simple structure of the jam processing cover 100C.

On the other hand, when the jam processing cover 100C is opened, by pushing down the operation button 100P, the rotation of the jam processing cover 100C in the opening direction (in this example, in the clockwise direction) is enabled at the point of time when the transferring roll 7 climbs over the lower end 20$Ft_0$ of the transferring roll holding portions 20F.

Moreover, as most clearly shown in FIG. 8, in the present exemplary embodiment, the high-voltage unit HV as the high-voltage power supplying unit is formed in an oblong board shape, and is disposed in a standing condition so as to be opposed to the back side of the unit case 20 (the opposite side of the opening; in this example, the front side of the apparatus body 100).

On the other hand, as most clearly shown in FIG. 9, in the unit case 20 according to the present exemplary embodiment, the charging roll 4, the exposing device 5, the cleaning blade 15 and the like are disposed along the peripheral surface of the photoreceptor drum 3. That is, the process unit 2 according to the present exemplary embodiment is structured so as to have the photoreceptor drum 3, the charging device 4 and the cleaning device 15. While in the present exemplary embodiment, the developing device 6 is accommodated in a separate development housing 6H attached to a lower part of the unit case 20, it may be accommodated in the unit case 20.

In the present exemplary embodiment, the developing device 6 is disposed in the opening provided on the side of the photoreceptor drum 3 so that a developing roll 6R as a developer holding member is rotatable in the direction of the arrow, and on the back side of the developing roll 6R, developer agitating and conveying unit such as a supplying paddle 6*a*, a supplying auger 6*b* and an agitating auger 6*c* for supplying developer to the developing roll 6R while agitating it is provided. While the developer may be either a one-component developer containing only toner or a two-component toner containing toner and carrier, in the present exemplary embodiment, a two-component developer containing toner and carrier is used.

At the time of imaging (image formation), predetermined high-voltages, that is, a charging voltage, a developing voltage and a transferring voltage are applied from the high-voltage unit HV to the charging device 4, (the developing roll 6R of) the developing device 6 and the transferring roll 7 according to the present exemplary embodiment at a predetermined timing through a high-voltage power supplying path.

Next, the structure of the high-voltage power supplying path according to the present exemplary embodiment will be further described with reference to the drawings.

As shown in FIGS. 11 to 14, the high-voltage power supplying path PL according to the present exemplary embodiment is formed of a conductive wire material WR disposed on the outer surface of the unit case 20 as the housing.

Figure 11:
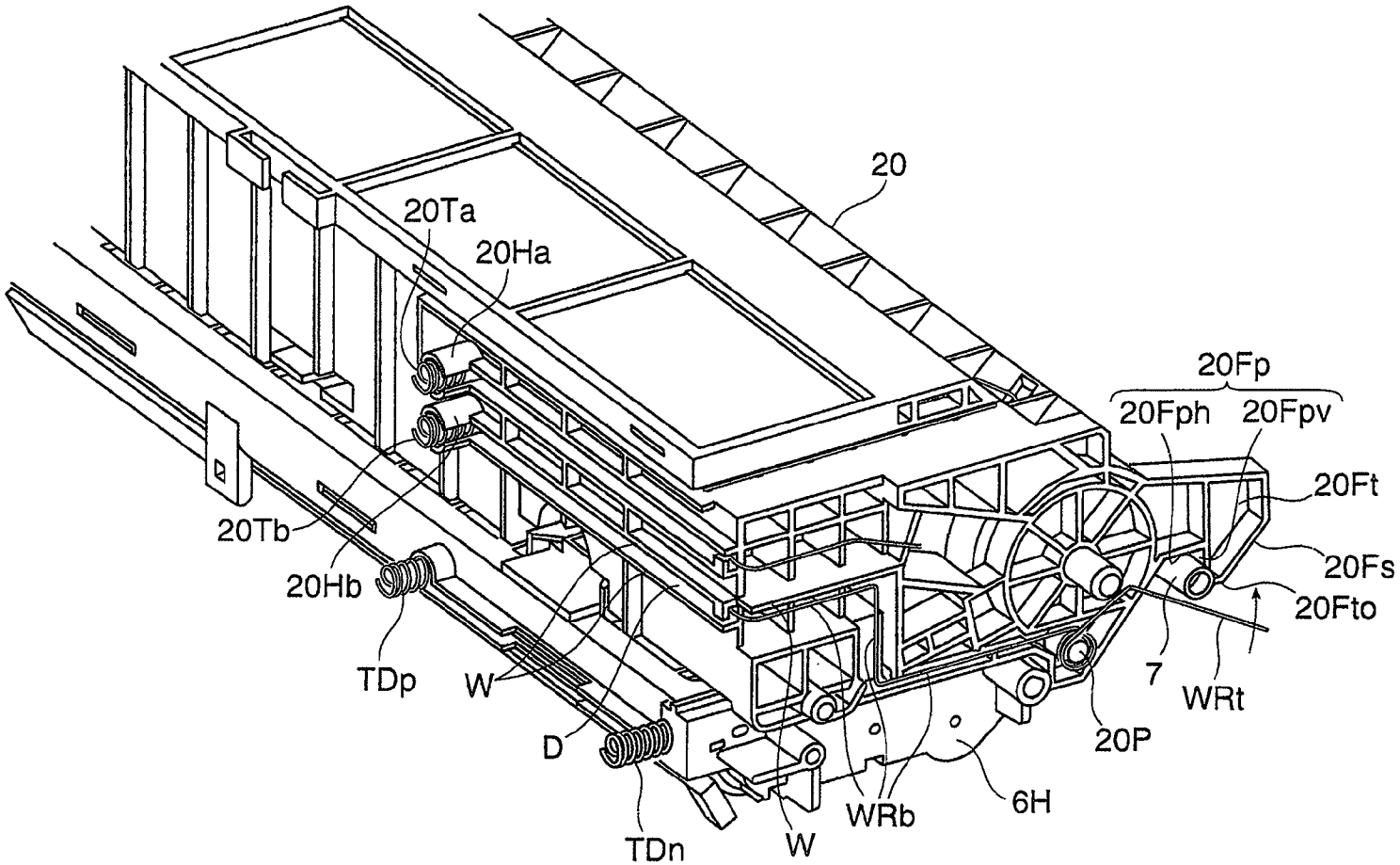
FIG. 11 is a perspective view showing the structure of power supplying paths according to the exemplary embodiment of the present invention.
Figure 12:
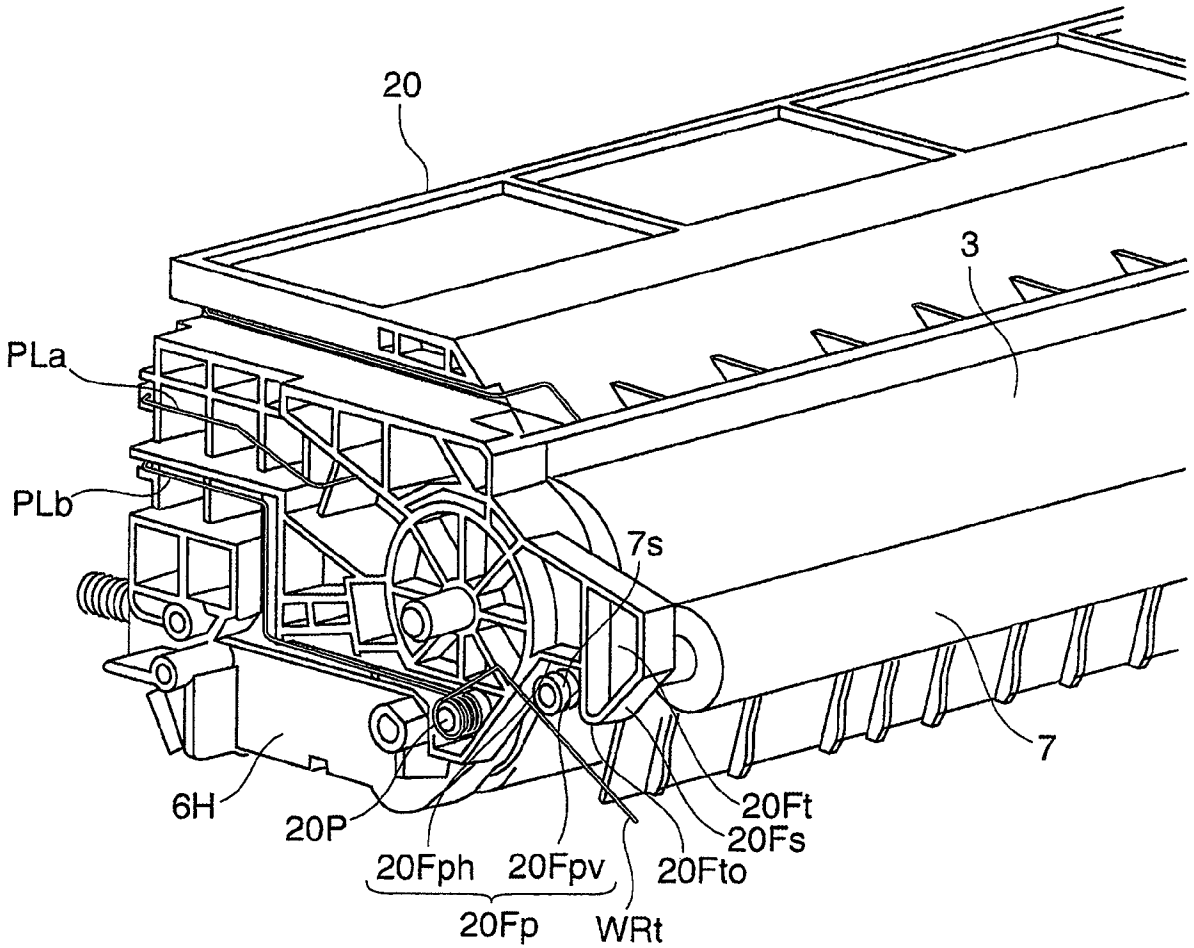
FIG. 12 is a perspective view showing the structure of the power supplying paths according to the exemplary embodiment of the present invention.

Specifically, as most clearly shown in FIG. 11, a hollow cylindrical protruding portion 20H having a notch for wiring at a part thereof is formed on the back surface of the unit case 20 opposed to the high-voltage unit HV, and in the hollow cylindrical protruding portion 20H, a connection terminal 20T formed by winding the conductive wire material WR in a coil form is disposed. The coil-form connection terminal 20T is formed so that an end thereof protrudes out of the hollow cylindrical protruding portion 20H, and by bringing (connecting) the connection terminal 20T into contact with (to) a non-illustrated corresponding electrode terminal provided on the side of the high-voltage unit HV, a predetermined high-voltage is applied to the conductive wire material WR (see FIG. 14). In the present exemplary embodiment, with respect to the connection terminal 20T of the unit case 20 and the high-voltage unit HV, the high-voltage unit HV is disposed so as to be substantially in the same direction as the pressing direction of the transferring roll 7, whereby when the transferring roll 7 is brought into contact with and separated from the photoreceptor drum 3 together with the jam processing cover 100C (particularly, when the transferring roll 7 is pressed against the photoreceptor drum 3), the position shift of the connection terminal 20T of the process unit 2 from the high-voltage unit HV which shift is a factor that causes poor contact or the like is prevented. Here, a connection terminal 20Ta is a charging roll connection terminal for supplying a voltage to be applied to the charging device 4, and a connection terminal 20Tb is a transferring roll connection terminal for supplying a voltage to be applied to the transferring roll 7.

Power supplying paths PLa and PLb according to the present exemplary embodiment are formed from the connection terminals 20Ta and 20Tb to the neighborhood of the corresponding devices to be supplied with power, along the outer surface of the unit case 20.

Reference designation TDp represents a power supplying terminal for the developing roll 6R provided in the separate development housing 6H attached to the lower part of the unit case 20. Reference designation TDn represents a spring terminal for the nip pressure for applying the pressing force of the developing roll 6R to the photoreceptor drum 3. In the present exemplary embodiment, from the viewpoint of uniformly applying the pressing force to the photoreceptor drum 3 in the axial direction, a nip pressure spring terminal TDn similar to the above-mentioned nip pressure spring terminal TDn is provided at the other end in the axial direction.

In the present exemplary embodiment, the power supplying path PLa for the charging device 4 that enables the power supply to the charging device 4 is disposed (laid) from the connection terminal 20Ta integrally formed in a coil form on the back surface of the unit case 20 to the neighborhood of the charging device 4 along the outer surface (in this example, the back surface and a side surface) of the unit case 20, by using a corresponding conductive wire material WRa.

On the other hand, the power supplying path PLb for the transferring roll 7 according to the present exemplary embodiment is disposed (laid) from the connection terminal 20Tb integrally formed in a coil form on the back surface of the unit case 20 to the neighborhood of the photoreceptor drum 3 along the outer surface (in this example, the back surface and the side surface) of the unit case 20, by using a corresponding conductive wire material WRb. Further, in the unit case 20 according to the present exemplary embodiment, a cylindrical support 20P formed so as to protrude in the axial direction is provided on the side surface in the neighborhood of the photoreceptor drum 3 (in this example, the side surface below the rotation shaft of the photoreceptor drum 3). The conductive wire material WRb is disposed from the side surface of the unit case 20 to the support 20P along the surface of the unit case 20, and then, wound at the support 20P. Then, an end WRt of the conductive wire material WRb is in contact with the conductive rotation shaft 7*s* of the transferring roll 7 therebelow.

Figure 13:
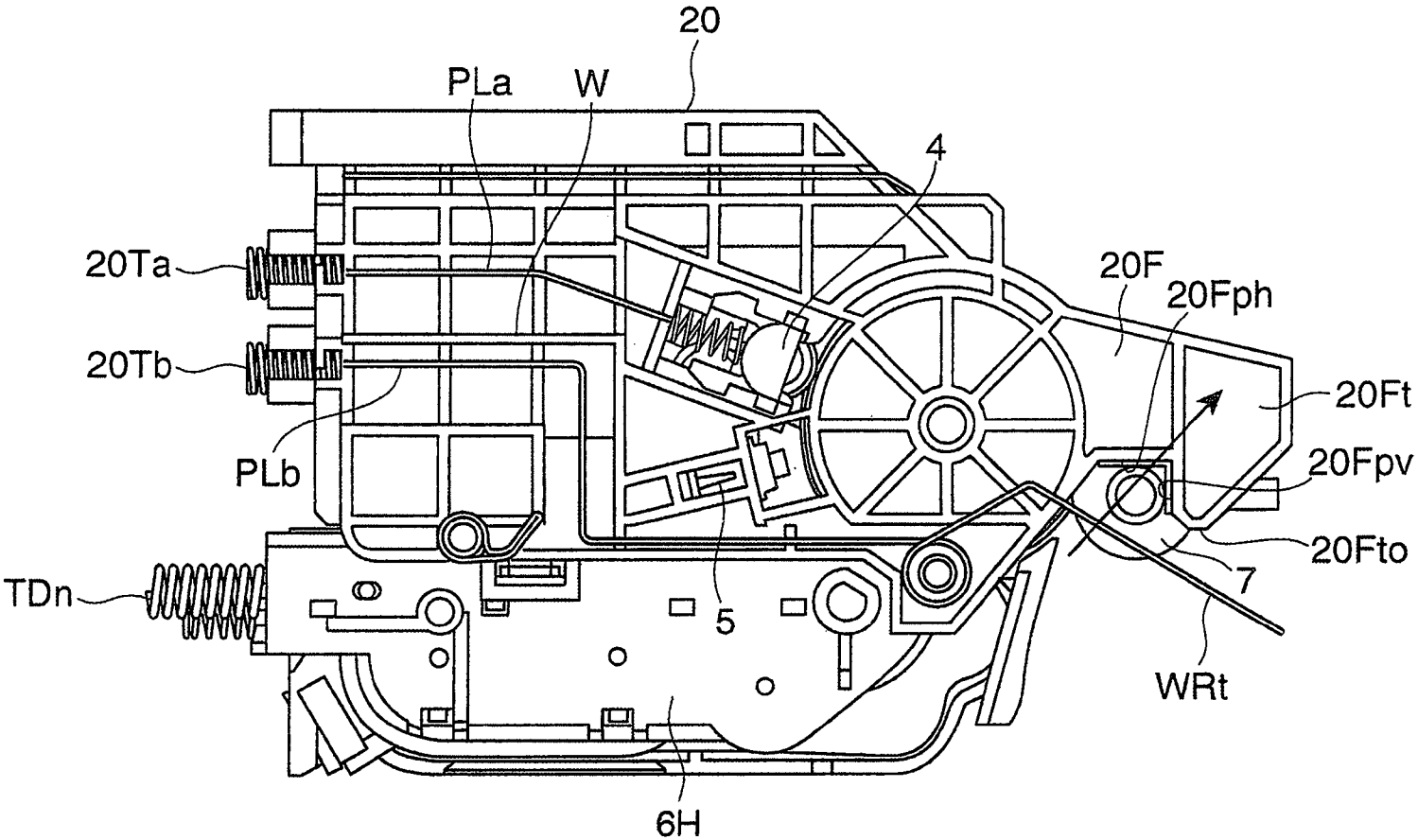
FIG. 13 is a schematic cross-sectional view showing the structure of the power supplying paths according to the exemplary embodiment of the present invention.
Figure 14:
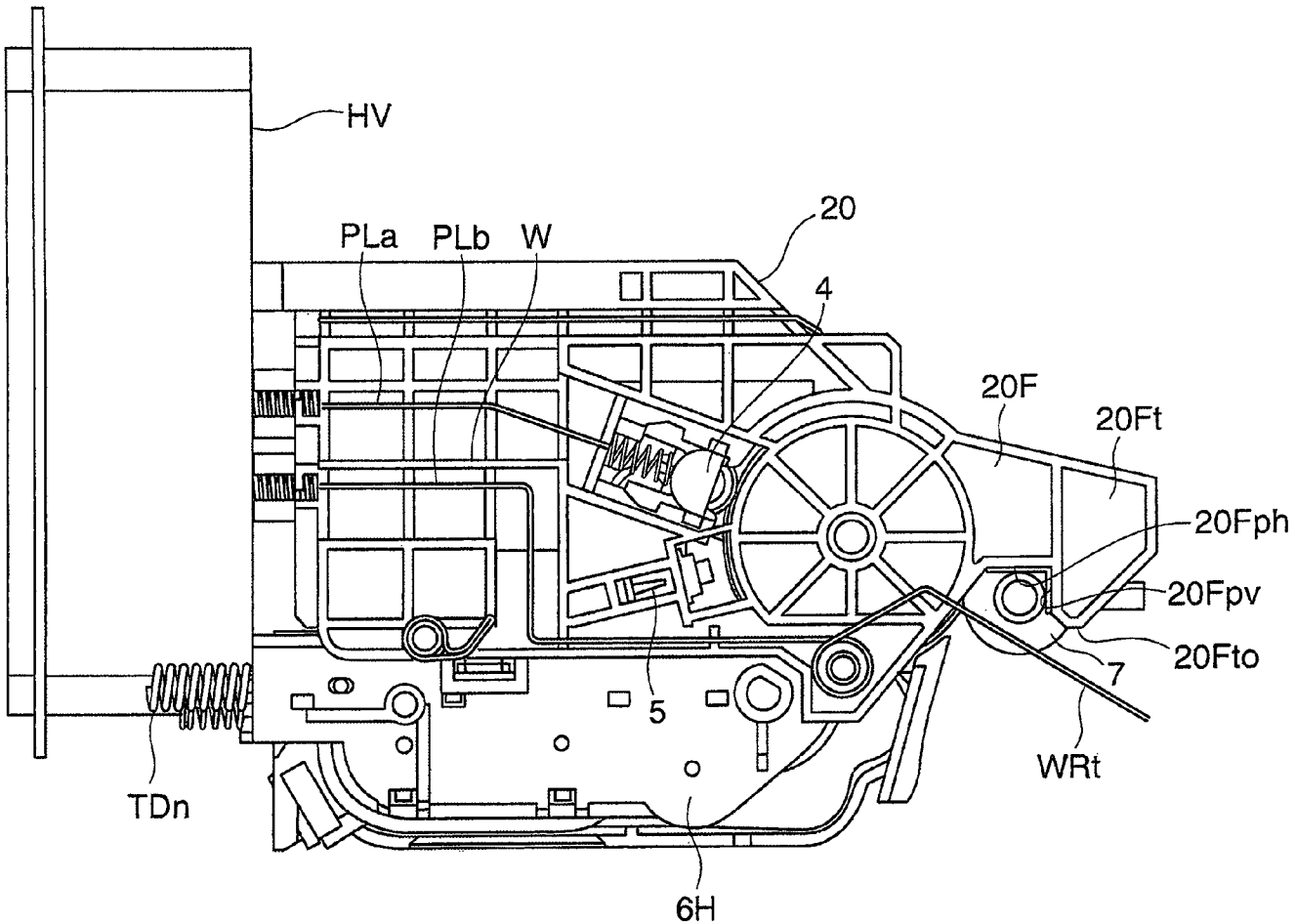
FIG. 14 is a schematic cross-sectional view showing the structure of the power supplying paths according to the exemplary embodiment of the present invention.

More specifically, the conductive wire material WRb is disposed so that the end WRt thereof is opposed to the transferring roll holding portions 20F of the unit case 20 with the transferring roll 7 in between, and is wound around the support 20P so as to form a torsion spring that pushes the transferring roll 7 in a direction in which it is situated in the predetermined contact position in the positioning portion 20Fp of the unit case 20 (in FIG. 13, a direction toward the horizontal surface 20Fph, a direction toward the vertical surface 20Fpv or a direction of the arrow toward the point of intersection of the horizontal surface 20Fph and the vertical surface 20Fpv). By forming a torsion spring by winding the conductive wire material WR around the support 20P of the unit case 20 as described above, a comparatively stable pushing force can be obtained with a simple structure.

Moreover, by providing the transferring roll holding portions 20F on the downstream side of the transferring roll 7 in the rotation direction of the photoreceptor drum 3 (by disposing the contact position in the positioning portion 20Fp and the end WRt of the conductive wire material WRb so as to be opposed to each other with the transferring roll 7 in between), the dropping off of the transferring roll 7 from the positioning portion 20Fp and the position fluctuations thereof incident to the rotation of the photoreceptor drum 3 can be effectively suppressed.

In the present exemplary embodiment, from the viewpoint of supporting the transferring roll 7 by uniformly pressing it in the axial direction against the photoreceptor drum 3, although not shown, a similar support 20P is provided on the opposite side surface of the unit case 20, a similar wire material WR is wound around the support 20P, and by the end portion WRt thereof, the other end portion in the axial direction of the transferring roll 7 is supported.

Moreover, in the unit case 20 according to the present exemplary embodiment, for example, as shown in FIG. 11, on the surface of the unit case 20 where the power supplying path PL is formed, a plurality of partition walls W protruding from the surface are formed, and the conductive wire materials WR are disposed in grooves D formed between the partition walls W. Thereby, problems such as the leakage to surrounding component members incident to a movement of the conductive wire material WR due to vibrations or the like are prevented with reliability. Some of the partition walls W have the function of ensuring the strength of the unit case 20. Thus, by using the walls necessary for ensuring the strength of the unit case 20, the circumference of the unit case 20 is prevented from increasing. It is not necessary that all the partition walls W have the function of ensuring the strength of the unit case 20, but they may be partition walls W added for problems such as the leakage. While the height of the partition walls W may be increased for the problems such as the leakage as required, from the viewpoint of preventing the circumference of the unit case 20 from increasing, it is favorable that the number of parts where the height of the partition walls W is increased are minimum.

In the printer 1 structured as described above, since the conductive wire material WR constituting the high-voltage power supplying path can be arbitrary disposed along the outer surface of the unit case 20 to the neighborhood of the component devices to be supplied with power, compared with the related structure in which the high-voltage power supplying path is provided in the unit case 20, it is unnecessary to dispose the power supplying path so as to avoid the rotation shafts of rotary members such as the photoreceptor drum 3, the charging roll 4, the developing roll 6R and a toner conveying member and the component members such as the toner accommodating portions and provide a complicated power supplying path in consideration of separation from members such as the charging roll 4 and the developing roll 6R to which a high-voltage is applied and grounded members such as the photoreceptor drum 3. Thereby, the degree of freedom of the setting of the power supplying path can be significantly increased, and the power supplying path can be simplified. Moreover, compared with the related structure in which the high-voltage power supplying path is provided in the unit case 20, it is unnecessary to secure an extra space inside the process unit 2 in consideration of separation from members such as the charging roll 4 and the developing roll 6R to which a high-voltage is applied and grounded members such as the photoreceptor drum 3. Thereby, the size of the process unit 2 can be reduced while the disposition of the component members in the unit case 20 is facilitated.

Moreover, since the power supplying path PLb according to the present exemplary embodiment is capable of easily supplying a predetermined high voltage also to the transferring roll 7 capable of being brought into contact with and separated from the photoreceptor drum 3 in synchronization with the jam processing cover 100C as described above and the rotation shaft 7*s* of the transferring roll 7 can be held in the predetermined position at both ends in the axial direction by the end portions WRt of the conductive wire material WRb wound around the support 20P, the predetermined position of the transferring roll 7 that applies the predetermined pressing force to the photoreceptor drum 3 can be maintained with stability. That is, the conductive wire material WRb according to the present exemplary embodiment not only functions as the power supplying path PLb to the transferring roll 7 but also performs the function as the holding unit for holding the transferring roll 7 in the predetermined position together with the transferring roll holding portions 20F of the unit case 20, and can contribute to size reduction and cost reduction consequent on reduction in the number of parts. The function as the holding unit is an additional function, and it is unnecessary to hold the transferring roll 7 only by the power supplying path PLb and the transferring roll holding portions 20F but different means may be used also for that purpose. However, it is undesirable to structure the transferring roll 7 so as to be in a direction opposite to the direction in which the transferring roll 7 is held in the predetermined position (direction that separates the transferring roll 7 from the predetermined position); since it becomes necessary to strengthen or increase the different means for holding the transferring roll 7 in the predetermined position, size reduction and cost reduction cannot be achieved.

Moreover, since the direction in which the transferring roll 7 is pressed against the photoreceptor drum 3 and the direction of connection between the connection terminal 20T of the process unit 2 and the high-voltage unit HV are substantially the same, when the transferring roll 7 is brought into contact and separated, the position shift between the high-voltage unit HV and the connection terminal 20T can be prevented, so that stable connection between the high-voltage unit HV and the process unit may be ensured.

While as the high-voltage power supplying path PL, the power supplying paths PLa and PLb to the charging roll 4 and the transferring roll 7 are shown as an example in the present exemplary embodiment, according to the power supplying path PL of the present invention, even when an arbitrary high-voltage device (for example, a charge removing and charging device that removes charge from the photoreceptor drum 3, or a cleaner that electrically removes toner from the photoreceptor drum 3) is added into the unit case 20, a power supplying path PL for such a high-voltage device maybe easily added. Consequently, the degree of freedom of design is significantly increased.

The technical scope of the present invention is not limited to the above-described exemplary embodiment, but various modifications or improvements may be made without departing from the purport of the present invention. For example, while in the above-described exemplary embodiment, the structure of the power supplying path according to the present invention is described with a monochrome black-and-white printer as an example, it is to be noted that such a power supplying path may be applied to color image forming apparatuses having a plurality of image forming units.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a housing that is fixedly placed in the image forming apparatus and integrally accommodates an imaging portion that includes at least an image holding member;

a transferring unit that is disposed against the image holding member so that the transferring unit is capable of pressing and separating the image holding member; and a high-voltage power supplying unit that supplies a high voltage, wherein a power supplying path that is formed on an outer surface of the housing so that the high voltage is supplied from the high-voltage power supplying unit to the imaging portion and the transferring unit via the power supplying path, and wherein the housing has a positioning portion that positions the transferring unit with respect to the image holding member, and the conductive wire material presses the transferring unit with an end of the conductive wire material so that the transferring unit is pressed to the positioning portion.

2. The image forming apparatus according to claim 1, wherein the power supplying path is formed of a conductive wire material, and the conductive wire material is disposed, along the outer surface of the housing, so that a force is applied in a direction that enhances a condition of the transferring unit being pressed against the image holding member.

3. The image forming apparatus according to claim 2, wherein the conductive wire material is wound around a support provided on the housing near the positioning portion, to thereby push the transferring unit to the positioning portion.

4. The image forming apparatus according to claim 1, wherein the high-voltage power supplying unit, the imaging portion and the transferring unit are disposed so that a direction of connection between the high-voltage power supplying unit and the imaging portion and a direction in which the transferring unit is pressed against the imaging portion are substantially the same.

5. The image forming apparatus according to claim 1, wherein a groove for the power supplying path is formed on a surface of the housing, and the conductive wire material is disposed in the groove.

* * * * *